US010165821B2

(12) United States Patent
Truelsen

(10) Patent No.: US 10,165,821 B2
(45) Date of Patent: Jan. 1, 2019

(54) SOLE FOR A SHOE, IN PARTICULAR FOR A RUNNING SHOE

(75) Inventor: Ejnar Truelsen, Tønder (DK)

(73) Assignee: ECCO Sko A/S, Bredebro (DK)

( * ) Notice: Subject to any disclaimer, the term of this patent is extended or adjusted under 35 U.S.C. 154(b) by 203 days.

(21) Appl. No.: 12/988,646

(22) PCT Filed: Jun. 22, 2009

(86) PCT No.: PCT/DK2009/000147
§ 371 (c)(1),
(2), (4) Date: Oct. 20, 2010

(87) PCT Pub. No.: WO2010/003414
PCT Pub. Date: Jan. 14, 2010

(65) Prior Publication Data

US 2011/0030245 A1 Feb. 10, 2011

(30) Foreign Application Priority Data

Jul. 5, 2008 (DK) ..... 2008 00948

(51) Int. Cl.
*A43B 13/12* (2006.01)
*A43B 21/06* (2006.01)
(Continued)

(52) U.S. Cl.
CPC ..... *A43B 5/06* (2013.01); *A43B 7/144* (2013.01); *A43B 13/026* (2013.01); *A43B 13/12* (2013.01); *A43B 23/22* (2013.01)

(58) Field of Classification Search
CPC ..... A43B 13/182; A43B 21/30; A43B 21/42; A43B 5/0419; A43B 7/142
(Continued)

(56) References Cited

U.S. PATENT DOCUMENTS 1,853,027 A 4/1932 Adams
4,794,707 A * 1/1989 Franklin et al. ..... 36/107
(Continued)

FOREIGN PATENT DOCUMENTS

DE 196 08 488 A1 9/1996
DE 10 2006 054 338 A1 5/2008
(Continued)

OTHER PUBLICATIONS

India Examination Report dated Oct. 26, 2017 re: Application No. 7367/DELNP/2010; pp. 1-5; citing: WO 200712368 A2, US 2007033835 A1, and KR 100828908 B1.
(Continued)

*Primary Examiner* — Sharon M Prange
*Assistant Examiner* — Timothy K Trieu
(74) *Attorney, Agent, or Firm* — Finnegan, Henderson, Farabow, Garrett & Dunner LLP

(57) ABSTRACT

A sole for a shoe, in particular for a running shoe, the sole having a polyurethane injected midsole, a longitudinally extending shank, and an outsole. The shank extends from the forefoot of the sole through an arch area to a heel area and has an opening in its heel area for receiving polyurethane during injection of the polyurethane for the midsole. Further, the shank has a cavity for receiving a comfort element. The heel area of the shank is offset to be closer to the outsole than the shank in the arch area. The sole provides a low weight sole while still providing comfort to the wearer of the shoe. By placing a comfort element in the cavity, in the heel area of the shank, which comfort element has a higher elasticity than the polyurethane of the midsole, the sole provides improved energy absorption and energy return.

15 Claims, 13 Drawing Sheets

(51) Int. Cl.

| | |
|---|---|
| ***A43B 13/42*** | (2006.01) |
| ***A43B 5/06*** | (2006.01) |
| ***A43B 7/14*** | (2006.01) |
| ***A43B 13/02*** | (2006.01) |
| ***A43B 23/22*** | (2006.01) |

(58) Field of Classification Search
USPC .... 36/107, 108, 76 R, 30 R, 28, 35 R, 25 R, 36/73
See application file for complete search history.

(56) References Cited

U.S. PATENT DOCUMENTS

| | | | | |
|---|---|---|---|---|
| 5,384,973 | A | 1/1995 | Lyden | |
| 5,528,842 | A * | 6/1996 | Ricci et al. | 36/27 |
| 5,542,196 | A * | 8/1996 | Kantro | 36/44 |
| 6,038,790 | A * | 3/2000 | Pyle | A43B 7/1425 36/28 |
| 7,377,056 | B2 * | 5/2008 | Snow et al. | 36/24.5 |
| 7,380,353 | B2 * | 6/2008 | Feller et al. | 36/76 R |
| 7,946,060 | B2 * | 5/2011 | Rosenbaum | 36/30 R |
| 7,958,653 | B2 * | 6/2011 | Howlett | A43B 7/142 36/35 R |
| 8,112,905 | B2 * | 2/2012 | Bemis et al. | 36/27 |
| 2003/0172548 | A1 * | 9/2003 | Fuerst | 36/28 |
| 2007/0003835 | A1 | 1/2007 | Hasegawa et al. | |
| 2007/0033835 | A1 | 2/2007 | Bray, Jr. | |
| 2007/0124960 | A1 * | 6/2007 | Friedman | 36/30 R |

FOREIGN PATENT DOCUMENTS

| | | | |
|---|---|---|---|
| KR | 100828908 | B1 | 5/2008 |
| WO | 2007123688 | A2 | 11/2007 |

OTHER PUBLICATIONS

Supplemental European Search Report dated Apr. 19, 2013 re: Application No. EP 09 79 3862; pp. 1-4; citing: WO 2007/123688 A2, U.S. Pat. No. 1,853,027 A, US 2007/03385 A1, DE 196 08 488 A1, U.S. Pat. No. 5,528,842 A and U.S. Pat. No. 4,794,707 A.

* cited by examiner

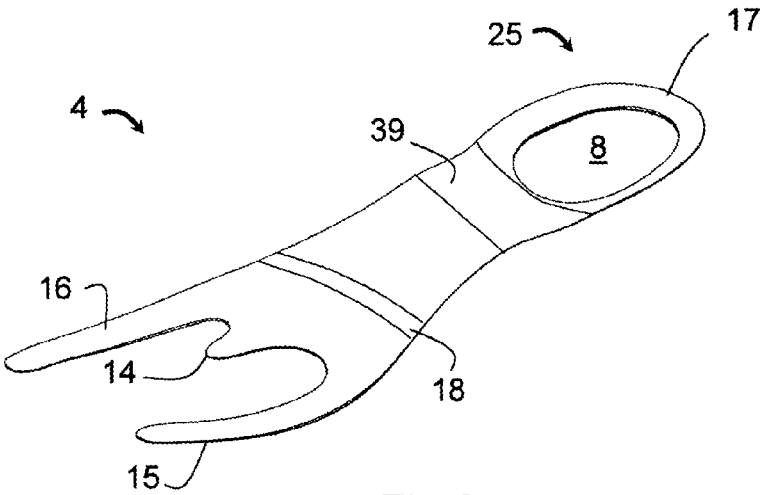
Fig.3a
Fig.3b
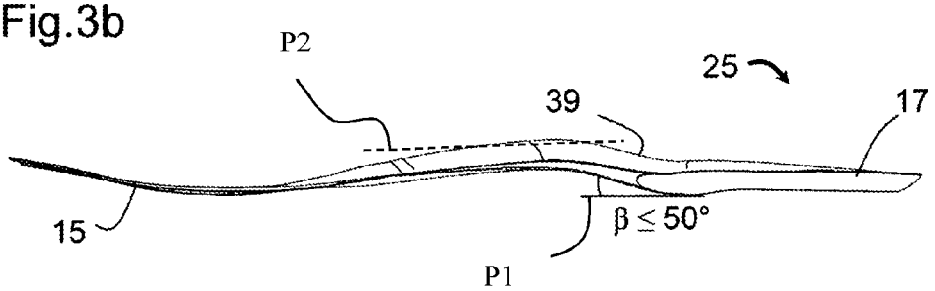
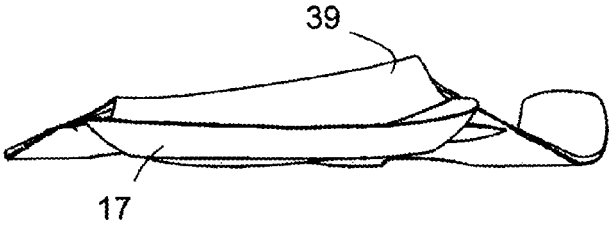
Fig.3c

Fig.13
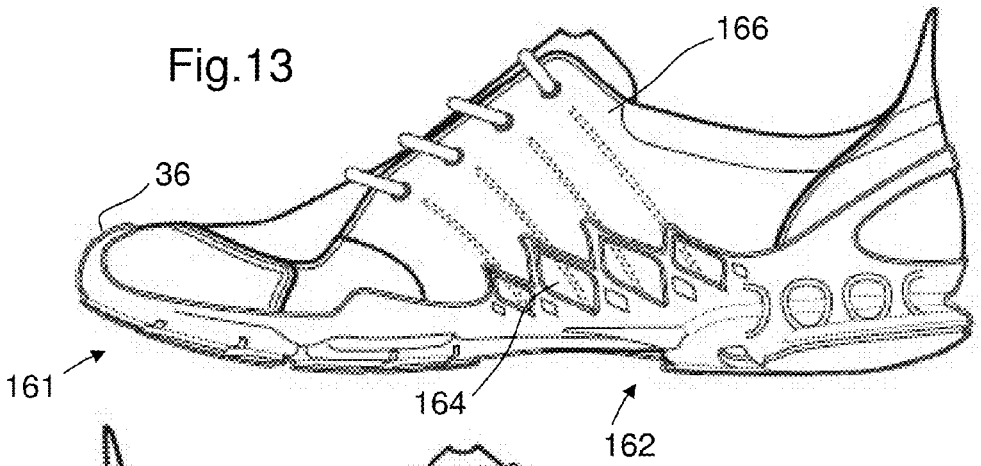
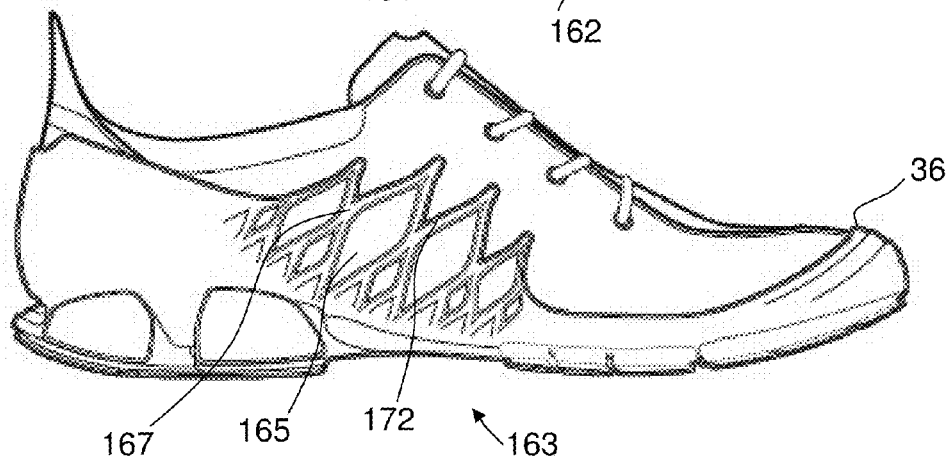
Fig.12

SOLE FOR A SHOE, IN PARTICULAR FOR A RUNNING SHOE

This is a National Phase Application filed under 35 U.S.C. 371 as a national stage of PCT/DK2009/000147, with the filing date of Jun. 22, 2009 an application claiming the benefit to Danish Application No. PA 2008 00948, filed on Jul. 5, 2008, the entire content of each of which is hereby incorporated by reference in its entirety.

The invention concerns a sole for a shoe, in particular for a running shoe. One type of running shoes of the state of the art has in common the concept of protection of the foot. More precisely, the shoe is considered a sheltering instrument for the foot. This protection concept has lead to relatively heavy running shoes, which often have a sole or insole with a high degree of cushioning in order to mitigate the force reactions stemming from the heel strike and acting on the ankle joint and the leg. The increased weight of the shoes takes away energy from the runner. Another type of running shoes are ultra lightweight shoes which often are below 300 grams. This type is minimalist having thin soles and thin uppers. When designing shoes, the shoe industry has for a long period had the natural moving foot as the ideal state of motion, e.g. barefoot running on grass, where the foot unconstrained by a shoe is allowed to perform its natural motion. However, once the shoe is on the foot, natural motion of the foot is impeded. As an example, the angle of the metatarsal phalangeal joint is reduced considerably when wearing shoes. The metatarsal joint angle is the angle between the ground and the metatarsal phalanges. If measured at the instant just before pushing off from the ground, this angle is in barefoot running close to 60 degrees and in so called technical or athletic running, where running shoes are used, reduced to only 35 degrees. Impediment of the natural motion of the foot means among other things that the muscles of the leg and foot which are active during barefoot running are also constrained. These muscles are not allowed to act with their full strength, and thus the shoe, if wrongly designed, will limit the ability of the runner to move efficiently. His performance is lowered as compared to barefoot running. Some of the key muscles during walking and running are musculus flexor hallucis longus and musculus extensor hallucis longus. The importance of these strong muscles when considering barefoot running in relation to running with shoes has already been acknowledged in U.S. Pat. No. 5,384,973, which is incorporated herein by reference. More specifically U.S. Pat. No. 5,384,973 describes a midsole for a running shoe which sole has a multiple of flex joints or grooves in longitudinal and transversal direction. A number of discrete outsole elements are connected to the midsole. This structure allows the toes of the foot to act independently and to increase the stability of the shoe. In particular, the flex joints have created an isolated sole area for the hallux, hereby allowing flexor hallucis and extensor hallucis longus to play a greater role during running.

As described above, although providing cushioning, the heavier running shoes take energy away from the runner because of the cushioning and because the heavy shoe due to its mass and distal point of gravity causes a counter torque on the foot when dorsi flexing during running. The runner must use energy to overcome this counter torque. On the other hand, the ultra light running shoes of the state of the art do not provide much structural support of the foot, nor do they sufficiently take into account biomechanical aspects.

Reducing the weight of a shoe can be made by minimising the upper and by design changes on the sole. On the sole, material can be removed or replaced with other types. Polyurethane (PU) has for many years been used in shoemaking, and in recent years a special light polyurethane version has been available. Making the midsole in PU, and especially the light PU, reduces weight. The use of PU as midsole does not, however, guarantee good comfort during running. A shank is needed in the sole in order to ensure stability in longitudinal and transverse directions of the shoe, because PU has a high degree of flexibility. Our running tests have shown however, that merely placing a shank between the human foot and the midsole gives an inferior running comfort. DE 196 08 488 A1 describes a shank embedded in a PU midsole, and suggests to make an opening in the heel area of the shank. PU from the midsole fills the opening, and in this way the heel area becomes soft and flexible. However, the shoe described is not a running shoe, and the sole still becomes too hard for running purposes. This drawback—the hard sole—unfortunately outweights the advantages achieved by fully omitting cushioning in the shoe and by reducing its weight.

The task solved in the present invention is how to design a sole, in particular for a running shoe, which sole has a low weight but still provides sufficient comfort.

This is achieved with a solution as described in claim 1.

By offsetting the longitudinally extending shank in the heel area of the sole, a cavity in the heel zone is created. This offset heel area is a platform on which a comfort element is placed, and fully or partly embedded by and bonded to polyurethane (PU) from the midsole during the injection process. The PU enters the cavity through a hole made in the cavity, or, more precisely, through an opening made in the offset heel area of the shank, and bonds the comfort element to the PU. Bonding happens during and after the PU injection process and locks the comfort element in its position. The PU will be distributed in the cavity by the pressure from the PU injection machinery. This bonding is of advantage, because without this adhesion the comfort element would cause noise during running, typically due to trapped air. The comfort element is more elastic than the PU used for the midsole, and in this way provides a higher degree of energy return than the PU from the midsole. The heel area is offset towards the outsole to a second horizontal plane different from a first horizontal plane of the arch area of the shank. Our tests have shown, that this design gives a better running experience because the heel area of the sole has become softer. The inventive solution is superior to a first alternative solution which did not prove successful, namely placing the shank between the midsole and the outsole. This placement lead to friction problems between the human heel and the heel of the midsole, because the midsole during running compressed and decompressed in the heel area, each compression allowing the human heel a movement downwards, and each decompression allowing the human heel to move upwards. Repeated movements downwards and upwards against the heel created friction and discomfort for the runner. On the other hand, in a second alternative solution, the shank could be placed on top of the midsole, hereby lowering friction because the shank as an early stiffening layer reduces the length of downwards and upwards movements. However, as already described, this solution proved to give too hard a sole. The inventive solution so to speak is placed between these two alternative solutions, because the forefoot and arch parts of the shank are placed on top or close to the top of the midsole, and the heel area of the shank is lowered and embedded in the midsole, and placed close to the outsole.

The surface of the comfort element facing the textile sole of the upper should preferably be kept free of PU midsole material hereby allowing its flexibility to have effect on heel strike. Thus all sides of the comfort element are surrounded by midsole material except said surface and those edge parts of the comfort element which rest on the shank.

Advantageously the comfort element is made with a nose protruding into the opening of the shank. This enables an even greater flexibility in the heel zone, because the amount of the relatively harder PU midsole material at the same time is lowered. The nose protrudes 1-2 millimeters into the opening towards the outsole, and can in some cases even extend below the opening of the shank.

As mentioned, the comfort element has an elasticity which is larger than the elasticity of the PU used for the midsole. By varying the ratio of the height of the comfort layer to the height of the PU layer in or below the cavity, a wide range of different hardness values can be reached. An advantageous ratio is achieved, where the PU has just filled the hole for entering the cavity, and the comfort element fills out the rest of the cavity. However, the ratio of the height of the comfort element to the height of the PU midsole below the cavity should not be too large as this would cause too much cushioning with the drawbacks already described. The ratio can be varied within a range of 2:1, and should preferably be below 1.5:1.

As the midsole should be as thin as possible in order to keep down the weight of the shoe, the hard shank can in some cases be felt by the wearer during running. This can be the case if the shank during the PU injection process has been embedded too close to the human foot, i.e. with no or only a thin layer of PU from the midsole in between a textile sole of the upper and the shank. In order to alleviate this problem, a thin layer of energy absorption material is placed just below the textile sole. The thin layer can be a discrete layer or mat, or it can be an integrated part of the textile sole covering the side facing the midsole and shank.

The transition from the arch area of the shank to the offset heel area must be made under a small angle. An abrupt transition, say 90° from the arch plane to the heel plane causes discomfort to the runner, who can feel a sharp edge. Therefore, the shank in the transition zone should have an angle of maximum 50° with the horizontal plane of the offset heel area, more preferred below 30°.

The transition zone not only slopes from the arch area towards the heel area, but also from the medial side of the shank to the lateral side. In this way the shank is raised to give support to the arch of the foot.

Preferably the hole or opening in the heel area of the shank is essentially elliptic and positioned above the point of touch down during running. Hereby, the full softening effect in the heel is achieved. In practice, the opening is placed in the middle of the offset heel area. The elliptical shape follows the shape of the human heel, and the positioning in the middle of the offset heel area creates a rim in the shank, on which rim the comfort element is resting.

The shank has curved fingers in the forefoot area, and has a hard region and a soft region. The fingers are bendable around a bending line between the hard region and the soft region of the shank, and the hard region starts where the fingers start extending from the main body of the shank and ends at the end of the heel. These fingers support in particular the first, fourth and fifth metatarsal phalanges.

The invention is now described by way of the drawings in which

FIG. 1 is a split view of the inventive sole

FIG. 2*a* is a cut away view of the inventive sole along an axis A-A

FIG. 2*b* is a cut away view of the inventive sole and a strobel sole

FIG. 3*a* shows the shank used in the inventive sole in a perspective view

FIG. 3*b* shows the shank of FIG. 3*a* in a side view

FIG. 3*c* shows the shank of FIG. 3*a* in a rear view

Figure 1:
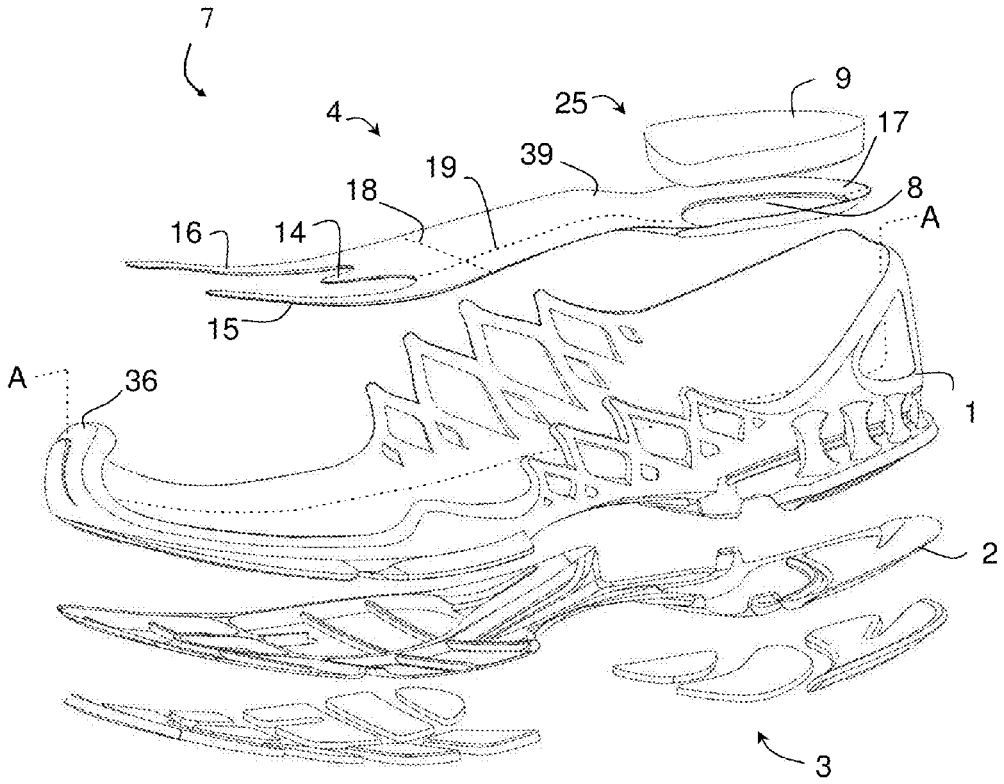
Figure 2A:
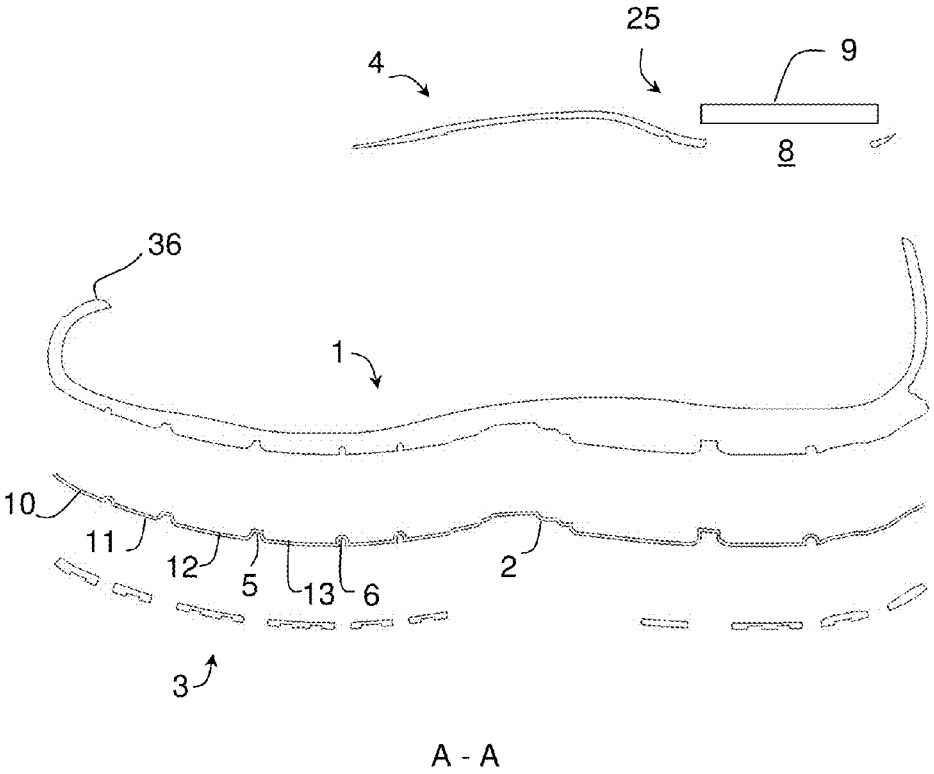
Figure 15:
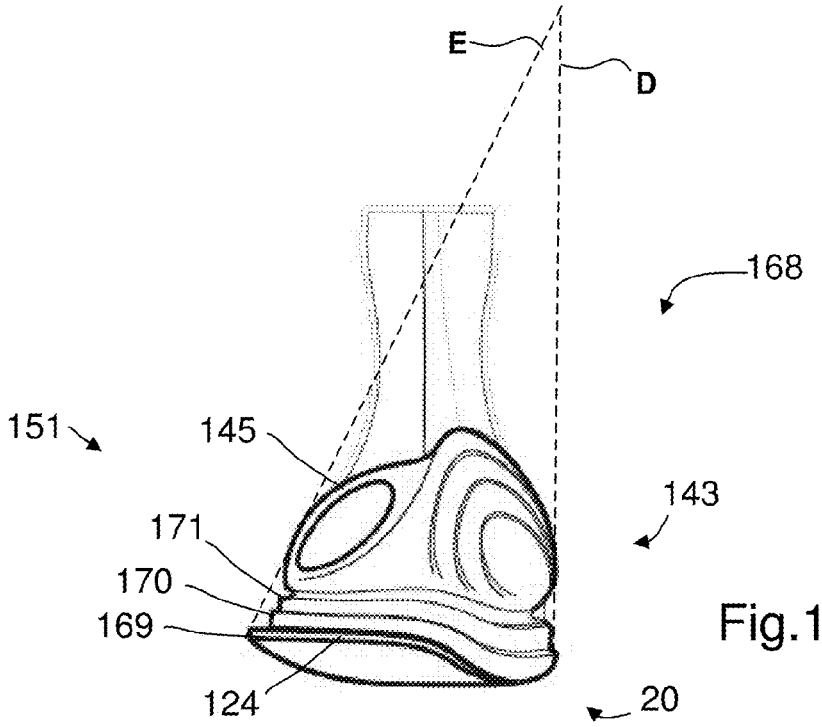
Figure 14:
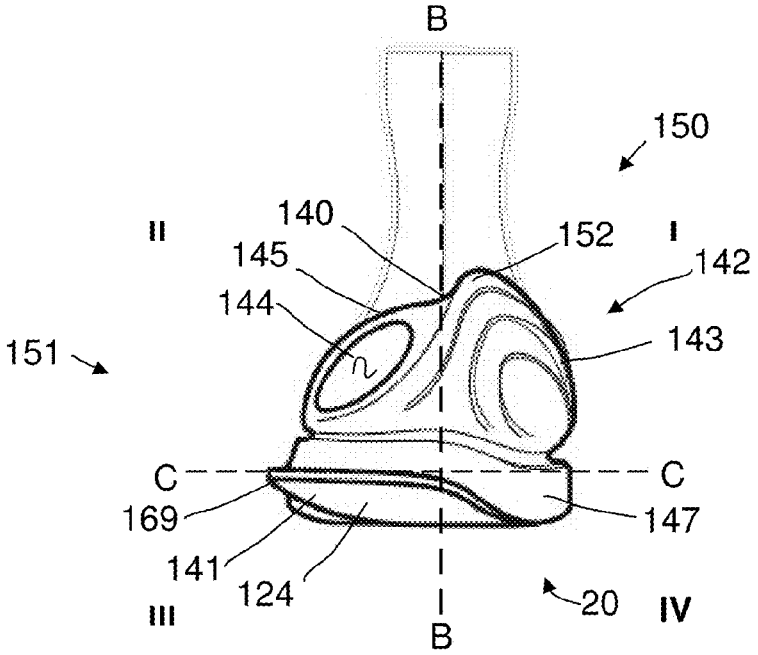

FIG. 12 is a view of an upper with an alternative midsole from the medial side FIG. 13 is a view of an upper with an alternative midsole from the lateral side FIG. 14 is a view of a first heel version of the midsole FIG. 15 is a view of a second heel version of the midsole FIG. 1 is a perspective view of the inventive sole 7. In this preferred embodiment, the sole consists of three layers and a shank, namely as first layer a midsole 1, a second intermediate layer 2, and a third layer 3 constituting the outsole. The shank 4 is shown on top of the midsole, but is after polyurethane (PU) injection fully or partly embedded in the midsole 1. FIG. 2*a* shows the sole in a longitudinal cut along the axis A-A of FIG. 1.

Midsole 1 is in the preferred embodiment made of light polyurethane material, also called PU light, based on polyester. PU light is a known variant of PU which has a low density (0.35 g/cm$^3$), i.e. is a lightweight material. A further characteristic is a good shock absorption, which characteristic is of importance for long distance running. Shore A hardness is between 38 and 40. Frequently, shoe manufacturers use ethylene vinyl acetate (EVA) as midsole material, because it has a lower specific gravity than PU light resulting in a lighter sole. However, EVA tends to quick ageing under frequent force influence from the foot. This ageing is seen as wrinkles in the material. EVA is not form stable, and after a while it is compressed and does not return to its original shape.

Midsole 1 is covered with the second intermediate layer 2 which has the same profile as the midsole. FIG. 2*a* shows this profile and the second layer 2 is so to speak a replica of the bottom of the midsole 1. Layer 2 has the function of a protective layer, consists of thermoplastic polyurethane (TPU), and is an intermediate layer which is thin, typically 0.5-2 millimeters.

The third layer 3 is the outsole, which consists of a number of discrete outsole elements (e.g. reference numbers 120-123 in FIG. 8), which together add up to be the outsole. Under the term "discrete outsole element" is understood a piece of outsole that is not cast or moulded in the same process as the midsole or the intermediate layer 2, but is added or bonded to e.g. layer 2 later. Further, a discrete outsole element is not connected to the other outsole elements. In more detail, the outsole 3 consists of a plurality of outsole elements which can be perceived as islands that are not interconnected, separated by one or more grooves in the midsole. The elements are preferably made of rubber. Instead of rubber, TPU can be used as material for the discrete outsole elements, but the gripping characteristics of TPU are inferior compared to rubber. The rubber used is a conventional Nitril Butadine Rubber (NBR), which is preferred for running shoes because of its relative low weight. For other types of shoes, latex (comprised of a mixture of natural and synthetic rubber) can be used. The outsole elements are spaced apart with grooves 5,6 in the intermediate TPU layer 2 and in the midsole 1, and are placed on protrusions or pads 10-13 (FIG. 2*a*) made in the intermediate TPU layer. The pads and grooves of the intermediate layer mate with the corresponding pads and grooves of the midsole.

Manufacturing of the sole 7 consisting of the sole parts 1, 2 and 3 and shank 4 (FIG. 1) is made in the following way. In a first step, the TPU intermediate layer 2 and the outsole elements 3 are produced in a separate manufacturing process to become an integrated entity. In a second step, the midsole 1 is connected to the integrated entity consisting of layer 2 and outsole 3. Step one and step two will now be described.

In step one, the TPU intermediate layer 2 and the discrete outsole elements 3 are manufactured to become an integrated entity. First the discrete outsole elements are manufactured in a rubber vulcanisation process. Then the outsole elements are placed in a mould, where TPU is inserted above the elements. The mould is closed, and under application of heat and pressure the TPU is shaped into the desired shape. After a curing time, the integrated entity of outsole elements and TPU intermediate layer is finished. Although the TPU layer is manufactured in a casting process, alternative manufacturing processes are available for producing the second layer 2. Thus, the TPU can be injection moulded in a known manner, or the TPU can be a foil-like raw material like a sheet placed above the outsole elements 3 before joining these elements and the TPU using heat and pressure. Bonding between the TPU intermediate layer 2 and the outsole elements 3 are made with glue which is activated by the heat during moulding the TPU onto the outsole elements. A simple adhesion without glue between TPU and rubber, during the moulding process proved not durable. Before adding glue between TPU intermediate layer 2 and outsole elements 3, the rubber surface of the outsole elements 3 must be halogenated in a process which removes fat from the rubber and thus enhances the adhesion.

In step two of the manufacturing of sole 7, the midsole 1 is unified with the integrated entity consisting of layer 2 and outsole elements 3 from step one, as well as with a shoe upper. More specifically, the TPU intermediate layer 2 with the outsole elements 3 is placed in an injection mould together with the shoe upper and the shank 4 (which is mounted on the footbed of the upper), after which PU is injected into the mould and bonds to the shoe upper with shank and to the integrated entity consisting of layer 2 and outsole elements 3. The PU thus bonds to the side of the TPU intermediate layer 2 which is closest to the human foot. After this second step, sole elements 1, 2 and 3 have become integrated into one entity.

The TPU intermediate layer 2 has a double function in that it lowers the breakability of the midsole and reduces the cycle time on the PU injection machinery. This will be detailed in the following.

In principle, the TPU intermediate layer can be omitted, and the isolated outsole elements placed directly in the mould by the human operator before PU injection. This would however cost processing time on the PU injection machine, because placement of the many discrete outsole elements takes time. Instead, by manufacturing the TPU intermediate layer 2 and outsole elements 3 in a separate process as described above, the PU injection machine is free to manufacture midsoles most of the time. Machine waiting time is reduced. However, the use of the TPU intermediate layer has a further advantage, namely reducing a tendency of the PU light midsole to break. If the discrete outsole elements 3 are placed directly against the PU light midsole without any intermediate layer 2, the midsole tends to break in durability tests. Such breakage will allow water to enter the shoe during wear. The reason for the tendency to break is that when injecting PU into the mould during manufacturing, air bubbles tend to occur in the midsole. The bubbles occur because the PU is not able to press out air around sharp edges in the channels of the mould. This is probably due to the low specific gravity of the PU. The result is that air bubbles are contained in the midsole, thus making the sole liable to penetration of water when the midsole breaks or experience cracks. TPU has a larger specific gravity, and does not cause problems with trapped air bubbles during manufacture. In other words, the midsole 1 is not liable to water penetration caused by air bubbles and breakage due to protection by the intermediate layer 2, which contributes to keeping the interior of the shoe dry.

As material for midsole 1, PU has been chosen over TPU. In principle, the whole midsole could be made of TPU, but PU light has a lower specific gravity thus lowering the weight of the shoe. Further, PU has good shock absorbing characteristic which is important especially for running shoes.

The shank 4 (FIG. 1) consists of a mixture of thermoplastic polyethylene (TPE) and nylon and is partly flexible. It extends longitudinally from the forefoot of the sole through an arch area to a heel area, and has in the heel area preferably an opening 8 (FIG. 3*a*), where the polyurethane used for the midsole 1 enters during the injection process. In the front end, the shank has two curved fingers 15 and 16 extending under a curvature in the longitudinal direction, and a small finger 14 in the middle. These fingers support in particular the first, fourth and fifth metatarsal phalanges. It has been found that two to three fingers suffice instead of having one supporting finger for each ray in the foot. The shank is designed to be "anatomical", i.e. it follows the average foot more closely than conventional shanks. The shank is manufactured in an injection process, and is made bendable in the transversal direction just where the fingers of the shank starts, corresponding to the distal end of the first, fourth and fifth metatarsal phalanges, see the line indicated by reference number 18 in FIG. 1. Depending on the design requirements, line 18 can be placed anywhere in a zone between the proximal and distal end of the first, fourth and fifth metatarsal phalanges. Thus, the shank is bendable in a direction orthogonal to the longitudinal axis of the sole. The bendability is achieved in a process during manufacturing of the shank, where thermoplastic polyethylene is injected from the heel end and nylon from the toe end. The two compositions meet at the bending line and the sole is bendable from this line 18 because polyester is soft compared to hard glass fibre. As a further measure, the shank is also flexible in its longitudinal direction along a line 19, because the shank should preferably be more flexible on the lateral side than on the medial side. With this measure, the torsional stiffness in the longitudinal direction is adjustable. FIGS. 3*a*-3*c* show the shank in more detail.

During manufacturing, the shank is glued to a strobel sole which together with the upper is mounted on the last. Such strobel sole is a flexible textile sole and typically sewn to the upper. The last with upper and strobel sole and shank is placed in the mould which is closed, after which PU is injected into the mould.

According to the invention, the shank 4 has an offset heel area 25 as shown in FIG. 3*a*. This offset heel area defines a cavity 17 for receipt of PU and/or comfort element 9. The offset heel area functions as a platform for the PU entering the essentially elliptically shaped opening 8. The cavity is made by a rim in the shank, which rim follows around the opening 8. The rim is sloping inwardly towards the opening, hereby defining the cavity 17. According to the invention, the PU partly fills the cavity, which, when taken at the centre of the opening, gives the following layering in the heel area from top to outsole: strobel sole, comfort element, PU, TPU intermediate layer 2 and outsole 3. In the arch area of the sole however, the order of the layers is: strobe sole, PU, shank 4, PU and TPU intermediate layer 2. As there is no shank material in the opening 8 of the heel, this area is more flexible.

Figure 2B:
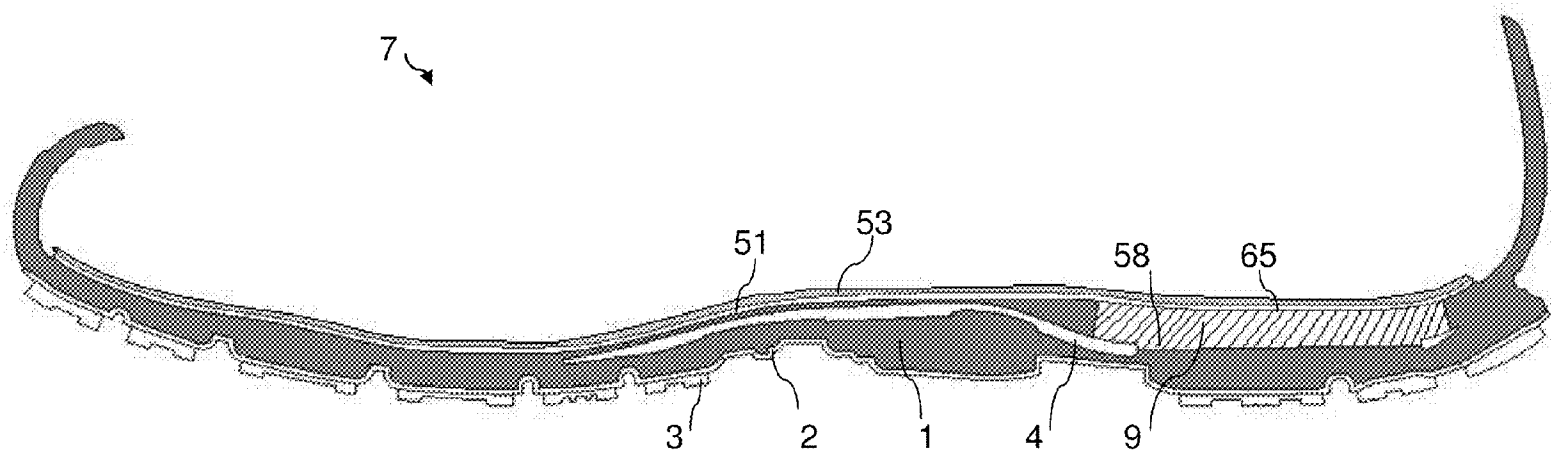

Comfort elements are well known and commercially available. In this embodiment, the comfort element is 9 millimeters in height, the PU midsole below is 8 millimeters, the TPU intermediate layer 1 millimeter and the discrete rubber outsole 3 is 2 millimeters. FIG. 2*b* shows the inventive sole in a cut away view, where the strobel sole is shown with reference numeral 53 (the upper is not shown in the Figure). The ratio between the height of the comfort element and the height of the PU midsole below can be varied in a wide range up to 2:1, but should preferably not exceed 1.5:1. Otherwise, the design would approach the conventional cushioning techniques, which as already described has drawbacks. Advantageously, the PU bonds to the comfort element by filling the opening 8 of the shank and surrounding the sides of the comfort element, hereby ensuring a fixation of the material without any further manufacturing steps. The surface 65 of the comfort element 9 facing the strobe sole is kept devoid of any midsole PU, as even a small layer of midsole PU would constrain its compression and decompression ability and hence the comfort in the heel zone. In one variant of the comfort element 9, the element has a flat surface as shown in FIG. 2*a*. In another variant as shown in FIG. 2*b*, the element can be equipped with a protrusion or nose 58, which nose fits neatly into the opening 8, and is only slightly smaller. The comfort element will thus rest on the rim of the shank and have a first height, while the nose extending into the opening gives the comfort element a second and larger height. The comfort element is preferably made in PU, and has a lower density than the midsole PU, thus being softer. By giving the comfort element a nose 58 as described an increased degree of softening is achieved in a controlled way and only allocated to a specific and delimited area in the heel zone. Advantageously, the comfort element made of PU has a higher energy return characteristic than the PU of the midsole.

Referring to FIG. 3*b*, a transition zone 39 in the shank between the arch area and the heel area should preferably not make an angle β of more than 50 degrees with the horizontal heel plane $P_1$ of the offset heel area. A larger angle provides discomfort to the runner due to a sharp edge. Advantageous angles are around 30 degrees. FIG. 3*c* shows the shank in a rear view. The transition zone 39 not only slopes from the arch area towards the heel area, but also from the medial side of the shank to the lateral side. In this way the shank is raised to give support to the arch of the foot. The heel area is offset towards the outsole to the horizontal heel plane P1, different from a horizontal arch plane P2 of the arch area of the shank. A vertical distance between the heel plane P1 and the ground plane is less than a vertical distance between the arch plane P2 and the ground plane.

The shank 4 is wholly or partly embedded in the PU midsole as shown in FIG. 2*b*. In the forefoot and in the arch area, the shank is placed close to the strobel sole 53, either with or without PU in between strobel sole and shank. In the offset heel area the shank is placed close to the outsole. As the midsole should be as thin as possible in order to keep down the weight of the shoe, the hard shank can in some cases be felt by the wearer during running. This can be the case if the shank during the PU injection process has been embedded too close to the human foot, i.e. with no or only a thin layer of PU from the midsole in between the strobel sole and the shank. In order to alleviate this problem, a thin layer of energy absorption material 51 is placed just below the strobel sole. This layer so to speak protects the foot against the shank, and the runner will not feel edges or surfaces of the shank at heel strike, because such material will absorb a high percentage of the energy on impact. Such material is commercially available from the company Rogers Corporation under the trade mark Poron® XRD. The layer consists of polyurethane foam and is between 0.5 mm and 1.5 mm thick, preferably 1 mm, and can be a discrete mat with a shape corresponding to the strobel sole. After placing the mat on the strobel sole of the lasted upper, the shank is attached to the mat, and the united body of upper, energy absorption material, strobel sole and shank is inserted into the mould for injection of the PU midsole. In another embodiment, the PU energy absorption material is already part of the strobel sole, i.e. this stretchable PU has in an earlier manufacturing process been adhered to the textile which is used as strobel sole, and forms one side of the strobel sole.

The PU energy absorption material can be stretched in all directions and has a low density (below 0.35 g/cm$^3$). Thus it has a lower density and is more soft than the PU used for the midsole.

A special insole has been provided. The insole consists of two layers. The upper layer is a polyester material, which is lightweight, and breathable. The bottom layer is made in two versions. For class A runners the bottom layer consists of EVA, which advantageously has a low weight, and for class B runners the bottom layer is made of PU foam. This is a more expensive solution, but gives a better insole. The bottom layer has through-going holes for breathing. In the heel portion of the insole an area with shock absorbing material is placed, and in the forefoot area of the insole an energy return material is placed which during push off releases most of the energy received during heel strike and full foot contact.

Figure 4:
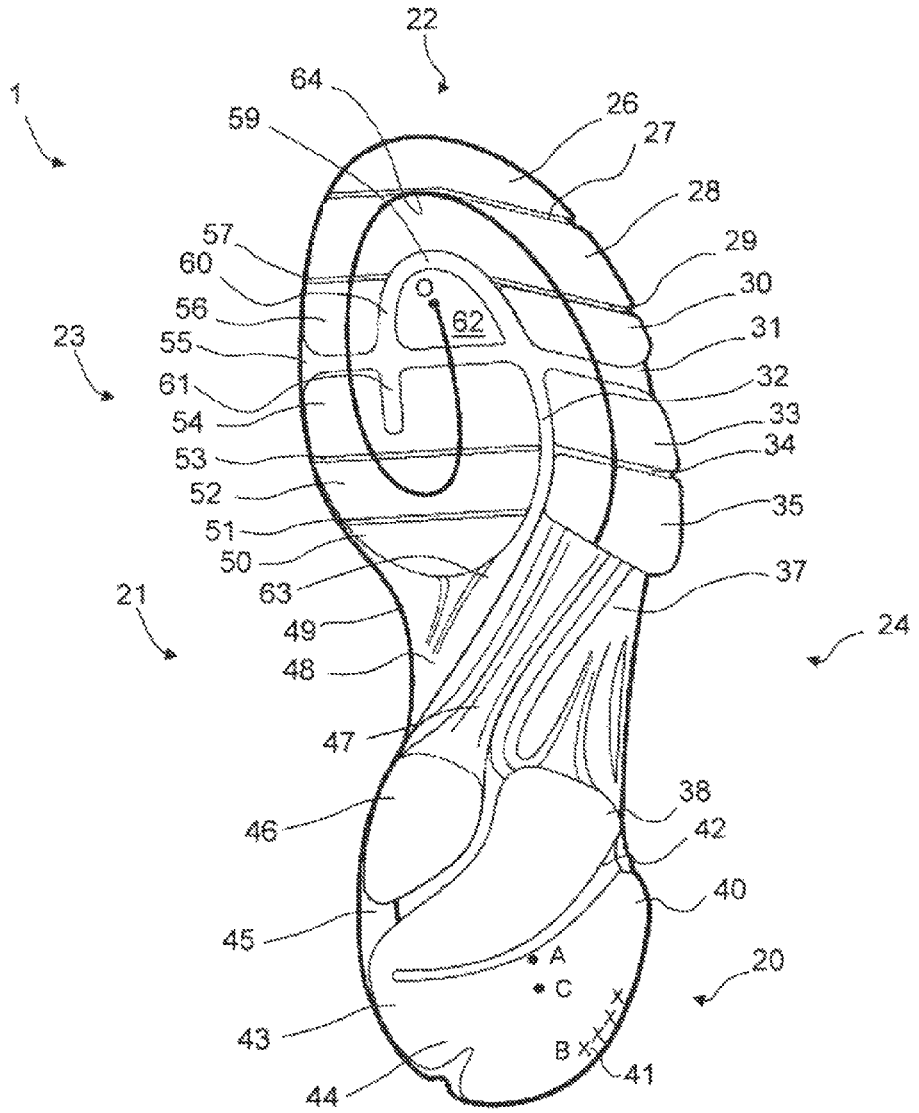
FIG. 4 is a view of a midsole seen from below

The midsole 1 is shown in FIG. 4 with a direct view from the bottom. The midsole has a forefoot portion 23, a top end 22, a lower heel portion 20, an arch portion 21 and a lateral side portion 24. Four flex grooves 27, 29, 31 and 34 traverse the forefoot 23. The grooves have a depth of approximately 50-60% of the thickness of the forefoot midsole, in this example 3-4 millimeters. A curved flex groove 63 extends from the medial side 49 of the arch portion 21 and continues along portions 48, 32, 59, 60 and 61. The flex grooves create protrusions or pads 26, 28, 30, 33, 35, 38, 40, 46, 50, 52, 54, 56, 62 which in shape correspond to the shape of the discrete outsole elements 3 but have a larger area. Thus, the pads are closer to each other than the discrete outsole elements mounted on the TPU intermediate layer 2. As will be described later, this has shown to have a positive effect on slip resistance. Pads 33 and 35 are extended in the lateral horizontal direction to become the most extreme points on the lateral side of the sole. When outsole elements are placed on the pads, this extension will contribute to stabilizing especially when the foot supinates. A reinforcement bar 47 runs slanted from the medial side to the lateral side. The reinforcement bar is part of the midsole and made during the injection process. It is thicker than the midsole on the lateral portion 37 and on the medial portion 49, and adds stiffness to the midsole. It runs parallel with the shank 4 (not visible on FIG. 4) which is placed on the other side of the midsole, i.e. the side facing the foot.

The curved flex groove is substantially wider than the other flex grooves. In one embodiment it is six millimeters wide, the flex groove 34 three millimeters and the flex groove 31 four millimeters. As a rule, the curved flex groove is between 1.5 and 3 times wider than the other flex grooves. The width of the curved flex groove can be varied, but it has preferably a width corresponding to 1-2 times the distance between the third and fourth metatarsal phalanges. However, the distance may not be too wide because this would cause too much flexibility. Further, the flex groove has essentially a constant width along its curve in the forefoot.

The curved flex groove 63 intersects the transverse flex grooves 29, 31 and 34. The curved flex groove thus runs in longitudinal direction from the medial side of the arch to an apex point 59 in the metatarsal zone of the foot. From this apex point the groove continues in the opposite direction along path 60 and crossing flex grooves 57 and 55. It ends approximately under the ball of the big toe in flex groove 61. The curvature of the groove in essence gives the sequence of midsole pads a spiral shaped character: Thus, starting in an origo point O in pad 62, a curve 64 can be drawn which describes a somewhat compressed or eccentric spiral graph. When mounted later in the manufacturing process, the discrete outsole elements 3 will describe the same curve.

Figure 5:
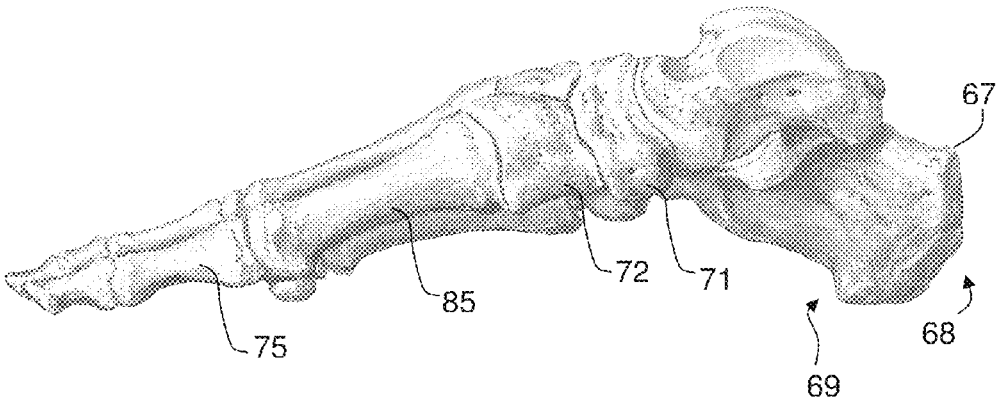
FIG. 5 is a drawing showing the bones of the medial side of the foot
Figure 6:
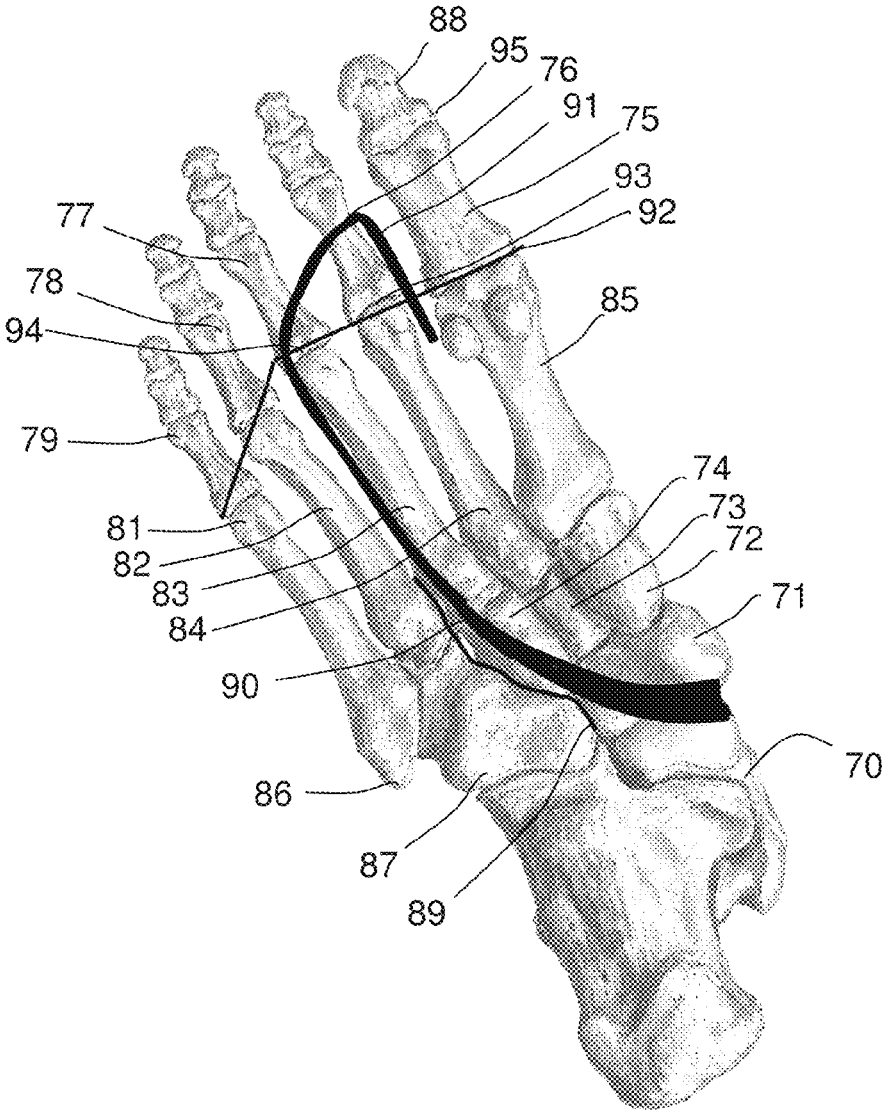
FIG. 6 shows the right human foot as seen from below

The function of the curved flex groove 63 is to enable natural running by giving the midsole a bending line in longitudinal direction between the fourth and the third metatarsal phalanges and hereby giving the characteristic "2-3 split" of the rays of the foot attention. This will be detailed in the following. FIG. 5 shows the bones of a right foot from the medial side with first metatarsal phalange 85, calcaneus 69, the tuberosity 68 and the superior tuberosity 67. FIG. 6 shows a right human foot from below. Reference number 70 describes the talus, 71 the navicular bone, and 72, 73 and 74 the three cuneiform bones, i.e. the medial, the intermediate and the lateral cuneiform bone respectively. Line 89 represents a folding line in the human foot between cuboid bone 87 on the one hand, and the lateral cuneiform bone 74 and the navicular bone 71 on the other. The foot is flexible and bendable along this folding line meaning that if bending is made along a longitudinal axis running between the fourth metatarsal phalanges 82 and the third metatarsal phalanges 83, the three most medial phalanges (83, 84, 85) will bend to one side, and the two most lateral phalanges (81,82) will bend to the other side. Recognizing this bending line by allowing the sole to be bent along this axis enable the supinating and pronating muscles to compensate faster after heel strike in the situation where the foot either pronates or supinates. Thus, in the case of a too large pronation, i.e. the case where the arch of the foot is moved to the medial side, the supinating muscle flexor hallucis longus will counteract by a plantar flexing reaction on the medial side of the foot. Counteraction will be faster with a sole having a curved flex groove, because musculus flexor hallucis does not have to "lift" the whole sole, but only a part of it, namely the part on the medial side of the curved flex groove, i.e. the part which comprises the first, second and third metatarsal phalanges. This supinating counteraction happens in order to get the ankle into neutral position where ideally no supination or pronation exists.

The outline of the curved flex groove 63 is shown with the line 90 in FIG. 6. This line shows where the curved flex groove is placed in the midsole 1. Note, that the flex groove 63 is placed on the side of the midsole facing the outsole. Curved flex groove 63, represented by line 90 in FIG. 6, emanates from the medial side of the arch and starts under the navicular bone 71. Alternatively the medial cuneiform bone 72. It crosses the lateral cuneiform bone 74 and continues between the third and fourth metatarsal phalanges up to the beginning of the joints between the metatarsal and proximal phalanges (75, 76, 77, 78, 79). These joints are shown by line 92, which also represents flex groove 31 in FIG. 4. The curvature of line 90 (i.e. groove 63) in the region of the cuneiform bones can be changed. Also the starting point of the curve on the medial side can be raised towards the toe end or lowered towards the heel.

Figures 10, 11:
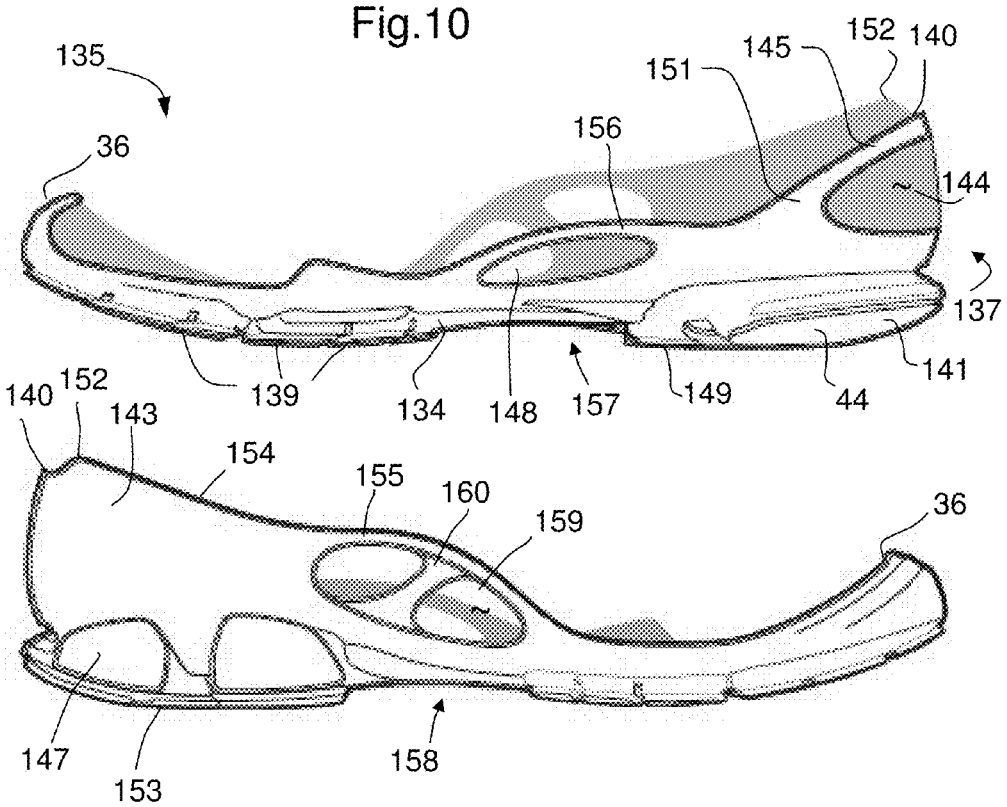
FIG. 10 is a view of the midsole from the lateral side
FIG. 11 is a view of the midsole from the medial side

Turning back to FIG. 4, an ideal landing point A is shown in the lower heel portion. This point is the optimum point of landing for a runner, and it is placed just below the calcaneus, offset to the lateral side. Real life test shows however, that in practice this optimum landing point cannot be reached. Typically, real life runners touch ground somewhere along the line marked B, reference number 41. The point of landing is dependent on the speed of running, and may even be different from right foot to left foot. However, moving the point closer to A results in improved force and energy consumption, and tests have shown that the point of landing with the sole can be moved to approximately C shown in FIG. 4. The basic idea with moving the point of landing as close to A as possible is the recognition that the muscles in the leg responsible for propulsion can be activated at an earlier time to become mechanically active—they are earlier in tension and able to create forward propulsion. In order to move this landing point as close to A as possible, two measures have been taken in the design. First, the height of the heel has been lowered or more specifically, the height of the lower heel portion 20 has been lowered in order to get the human foot as close as possible to the ground. Compared to state of the art running shoes, this height can be reduced, because the inventive design does not make extensively use of extra cushioning materials in the sole. Cushioning is an inherent characteristic of the PU midsole material used. In general, cushioning should not be avoided but kept to a minimum because it absorbs energy without returning it to the foot. In the preferred embodiment the maximum height or thickness of the midsole in lower heel portion 20 is between eight and twelve millimeters, preferably eight millimeters. This is the heel spring of the midsole and corresponds to the thickness of the heel in point A of FIG. 4. In order to provide a softened touch down during running, the shank 4 (FIG. 1) is embedded in the lower heel portion 20, and has according to the invention its opening 8 above point A. The second measure taken in order to move the point of landing closer to A is by designing the lower heel portion 20 of the midsole 1 with a double tapering. FIG. 14 shows the rear of the foot 150 wearing a shoe with the midsole 1 and discrete outsole element 124. The midsole in the rear foot area is asymmetrical around a vertical line B-B dividing the midsole into two halves. In the optimum upright standing position, the vertical axis B-B would go through the ankle joint and the tibia. The midsole is split into a medial heel portion 143 and a lateral heel portion 151. Further, a horizontal line C-C divides the midsole in the rear foot area into the lower heel portion 20 and an upper heel portion 142. The lines B-B and C-C together divides the heel of the midsole into four sections: I, II, III and IV. It is clear from the drawing, that none of the four sections I-IV are identical. The tapering 141 enables the foot to touch down in point C (FIG. 4). As seen in FIG. 14, the tapering is not only in section III, but also partly in section IV. In section IV, i.e. on the medial side of lower heel portion 20, the tapering stops, and becomes aligned with a geometric plane corresponding to the geometric plane of surface 149 (FIG. 10). FIG. 10 shows the tapering in more detail, and it will be understood that the tapering not only runs from the centre of the lower heel portion 20 towards the lateral side as depicted in FIG. 14, but also from the centre towards the heel end. FIG. 11 shows with reference number 153 that on this point of the medial inner side of the heel, the lower heel portion has full contact with the ground via an outsole element. Support 147 are an integral part of the midsole.

On heel strike, the midsole and outsole is designed to allow so called horizontal flexing. This is achieved with the curved heel flex groove 45 of FIG. 4, which groove is deeper and wider than the transverse flex grooves in the forefoot, and has the function of decoupling the heel of the sole from the forefoot sole in order to allow "horizontal flex", i.e. in order to allow horizontal movement of the heel portion especially during heel strike. This functionality can be compared to the human fat padding in the heel area which also allows a small horizontal movement back and forth.

In FIG. 15 a second embodiment 168 of the heel of the midsole is shown. The lower heel portion 20 is provided with steps 169, 170 and 171. These steps are staggered in relation to each other and made as part of the midsole in PU. The staggered steps 170 and 171 are made in order to stiffen the lower heel portion. Such stiffening effect is provided by direct injected PU in edge zones. Step 169 which is also shown in FIG. 14, clearly extends longer to the lateral side than the rest of the midsole in the heel portion, e.g. as compared to support arm 145, and is provided to achieve enhanced stability. It will be noted from FIGS. 14 and 15, that the medial heel portion 143 essentially can be aligned with a vertical line D, whereas the lateral heel portion 151 is aligned with a slanted line E.

Comparative tests between the inventive running shoe and a state of the art running shoe have been made. 12 male test persons were using the inventive shoes and the state of the art shoes. Using a goniometer placed on the heel of the persons, foot switches for detecting ground contact and an accelerometer mounted on the tibia muscle, different parameters as angles, velocities and accelerations have been measured. Table 1 shows the comparative test results.

TABLE 1

Comparative test

| | Inventive shoe | State of the art running shoe |
|---|---|---|
| Rear foot angle at touchdown (negative angle = inversion) | −3.4° | −2.8° |
| Maximal rear foot angle (positive angle = eversion) | 10.2° | 10.1° |
| Rear foot angle velocity at touchdown | 175°/s | 340°/s |
| Maximal rear foot angle velocity | 390°/s | 480°/s |
| Mean rear foot angle velocity | 200°/s | 290°/s |

The rear foot angle at touchdown was a bit larger than in the state of the art shoe. Thus the heel as a mean value was turned 3.4° to the lateral side measured in relation to the ideal zero degree situation. The maximal eversion angle on the other hand was found to be 10.2° as compared to 10.1° of the state of the art shoe. The maximal eversion angle is the angle measured when the heel of the foot turns to the medial side. Of particular interest are the velocity dynamics during touchdown, where the maximal rear foot angle velocity is 390°/s (degrees per second) as compared to 480°/s on the state of the art shoe and the mean rear foot angle velocity 200°/s as compared to 290°/s. In the eyes of the applicant this is a significant difference, because the lower mean and maximum velocity results in a more stable shoe. This means that from the instant the heel hits the ground until eversion is finished, the shoe is significantly slower and thus more stable. The result is a reduced risk of injuries in the ankle. The low mean rear foot angle velocity is partly due to the fact that the shoe has a low heel which advantageously brings the foot very close to the ground.

Figure 7:
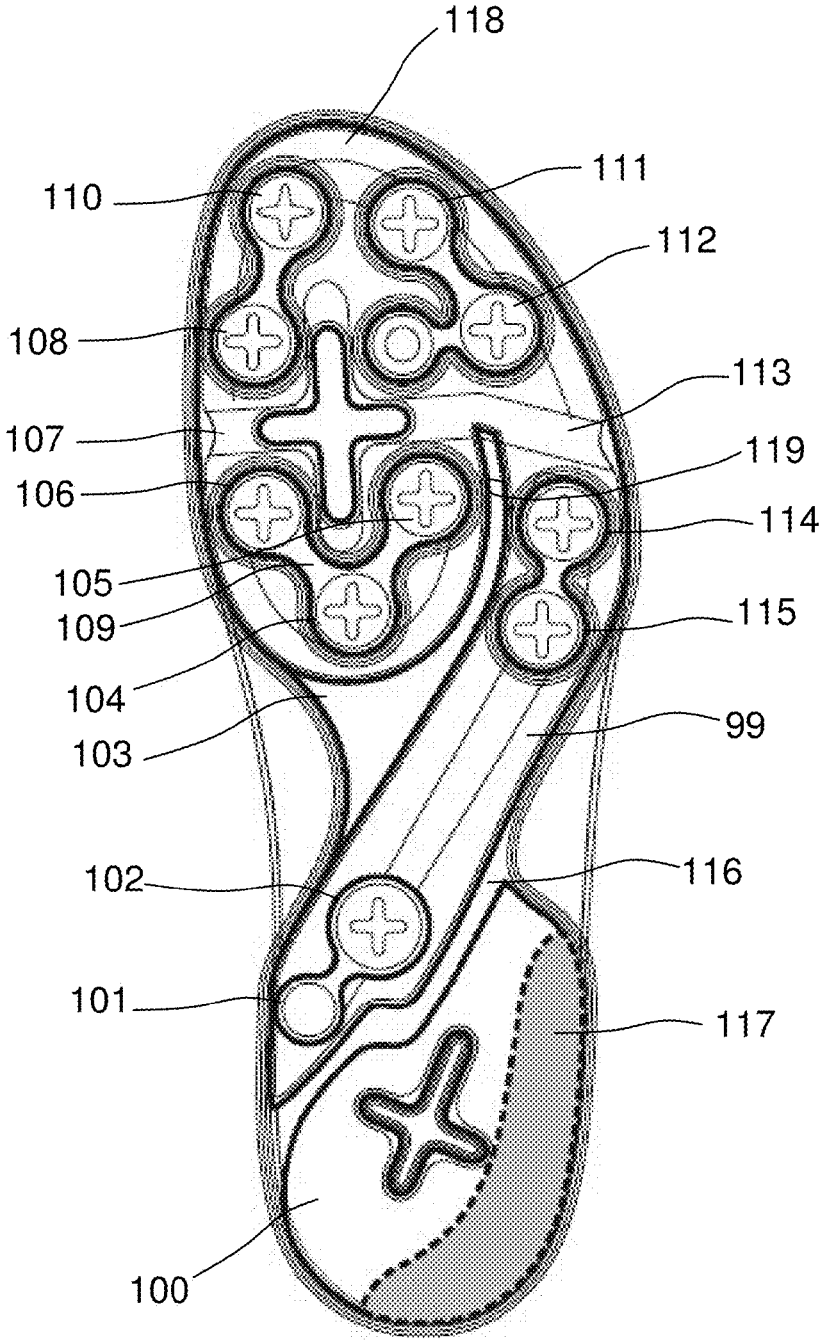
FIG. 7 is a further view of the bottom of a midsole and an outsole

FIG. 7 shows a further bottom view of a midsole 118 slightly modified in comparison to midsole 1 of FIG. 4. Apart from the modified midsole, FIG. 7 departs from FIG. 4 in that the midsole 118 has discrete circular outsole elements (101, 102, 104, 105,106, 108, 110, 111, 112, 114, 115) mounted on the midsole. Further, FIG. 7 shows the curved flex groove as reference number 103 following a path 119 up to transversal flex line 113. This flex line corresponds to line 92 in FIG. 6. Also in the embodiment of FIG. 7, an imaginary eccentric spiral curve can be drawn starting with an origo O (curve not shown) in outsole element 105 and continuing via 104, 106, 108, 110, 111, 112, 114 and ending at 115, hereby curving around the curved flex groove 103. Also here, the outsole elements are discrete. Thus, elements 104,105 and 106 although bridged by connection 109, can be made as isolated outsole elements. Element pair 108,110 is another discrete outsole element. FIG. 7 shows that the curved flex groove 103 can stop at the level of flex line 113. This sole design will also contribute to increased flexibility of the foot and faster reaction to excessive supination or pronation. In the heel portion a tapered area 117 enables moving the point of landing closer to the centre of the heel sole. An outsole element 100 is spaced apart from a reinforcement bar 99 by a heel flex groove 116.

Improvements can be reached by further continuing the curved flex groove. Turning to FIG. 6, the curved line 90 continues as curved forefoot line 91 across the third and second proximal phalanges and makes a U-turn in the direction of the heel. The curve 91 now runs in an opposite direction between the first and second metatarsal phalanges. This trajectory is also the one shown in the midsole of FIG. 4 and corresponds to the one seen in FIG. 8.

Figure 8:
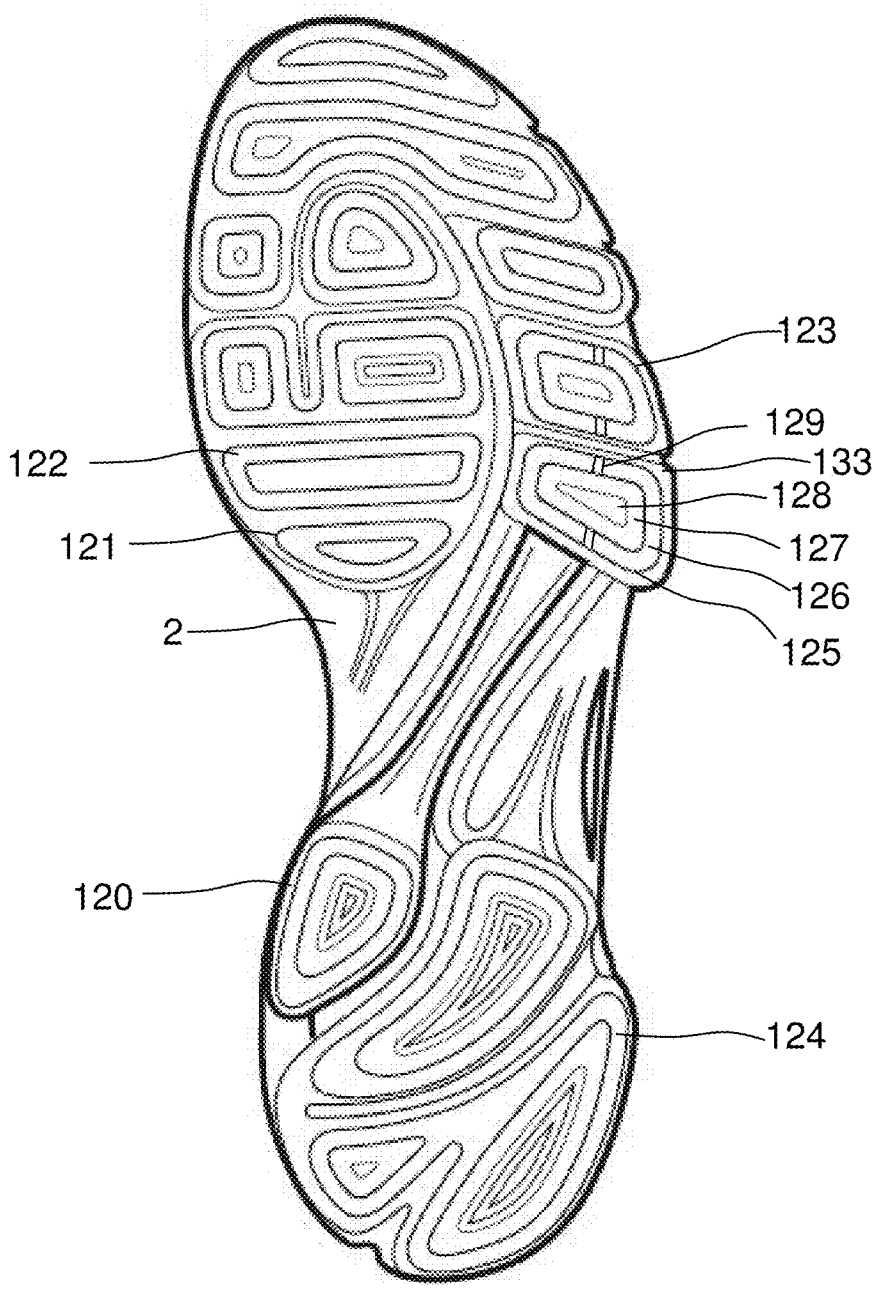
FIG. 8 is an even further view of the bottom of a midsole and an outsole

In more detail, FIG. 8 shows a further example of the midsole, which in the figure has a TPU intermediate layer 2 and discrete outsole elements (120, 121,122,124,125) fixated. The discrete outsole elements function as the tread of the shoe. Due to the flex grooves between the discrete outsole elements, the total outsole area is small compared to conventional outsoles. This has an effect on the slip resistance. The outsole area, which can also be perceived as a contact area between outsole and ground, has been further minimised by removing material from the central portion of the outsole elements. More specifically, the contact area of an outsole element in the elements of FIG. 8 is the area close to the edge of the element, whereas the centre of the outsole element is either devoid of material or only having a small contact area. Removing material from the outsole elements has the advantage of reducing the weight of the shoe, which is of particular interest in running shoes. Despite this reduction and the small surface area, a surprising effect has been seen regarding icy surfaces, because the grip of the sole has been improved compared to conventional soles. This is partly due to the material of the sole which is as mentioned rubber, and partly due to the "islandic" structure of the sole. As an example, the discrete outsole element 125 of FIG. 8 has a first plane surface 126 and a second plane surface 127. The second surface is lowered in relation to the first surface and a third surface 128 is in the same plane as the first. A fourth plane surface 133 constitutes the surface of the TPU intermediate layer 2, and is lower than plane surfaces 126 and 127. The surface area 133 essentially corresponds to the surface area of a pad of the midsole (see pad 35 in FIG. 4), albeit a bit larger due to the TPU intermediate layer which is covering the pad. As can be seen on FIG. 8, the discrete outsole element 125 covers a smaller area than the corresponding pad in the midsole. This means, that neighbouring discrete outsole elements have a larger distance to each other than the pads in the midsole as can be seen by comparing the distance between outsole elements 125 and 123 of FIG. 8. In the current embodiment, the distance between outsole elements 123 and 125 is five millimeters, and the distance between element 122 and 125 ten millimeters. The relatively large distance between the discrete outsole elements increases the flexibility of the sole, and has, as already described, led to good characteristics on slip resistance. Further, by making the area of an outsole element smaller than the corresponding area of TPU intermediate layer and pad, peeling effects on the outsole elements can be avoided. They will be less inclined to loosen as the bonding between TPU and rubber is made on a plane surface away from edges of the surface 133.

The discrete outsole element 125 has sharp edges in an angle of about 90 degrees. When walking on an icy surface, the sharp edges penetrate the ice which creates a better grip. The total length of the sharp edges amounts to the sum of the circumference of the discrete outsole elements. The longer, the better grip one gets. However, with the design described, the grip has been even further improved. Without being bound by the following theory, it is believed that the flexible discrete outsole elements allow the foot to react in a natural way in the case of an icy surface. If you slip on one part of the foot base, the human brain will via a muscle action instruct another part of the same foot base to instantly and automatically compensate and try to get a grip to the ground. Conventional outsoles prevent this compensation because the compensational muscle reaction is constrained by the normal sole. A discrete outsole as in the current design, however, having flexible outsole islands, allows the discrete action of one or more of the 32 muscles in the foot. The improved gripping characteristic of the sole was confirmed in laboratory tests in comparison with state of the art running shoes. Slip resistance showed to be improved both in relation to a wet surface and in relation to an icy surface. An improvement in slip resistance of the outsole of FIG. 8 can be made by building channels 129 into the first surface 126. On wet surfaces, aqua planning can arise because water is trapped in the groove of the lower second surface 127. Channels 129 will allow the water to escape, hereby lowering the risk of aqua planning and increasing the slip resistance even further.

Figure 9:
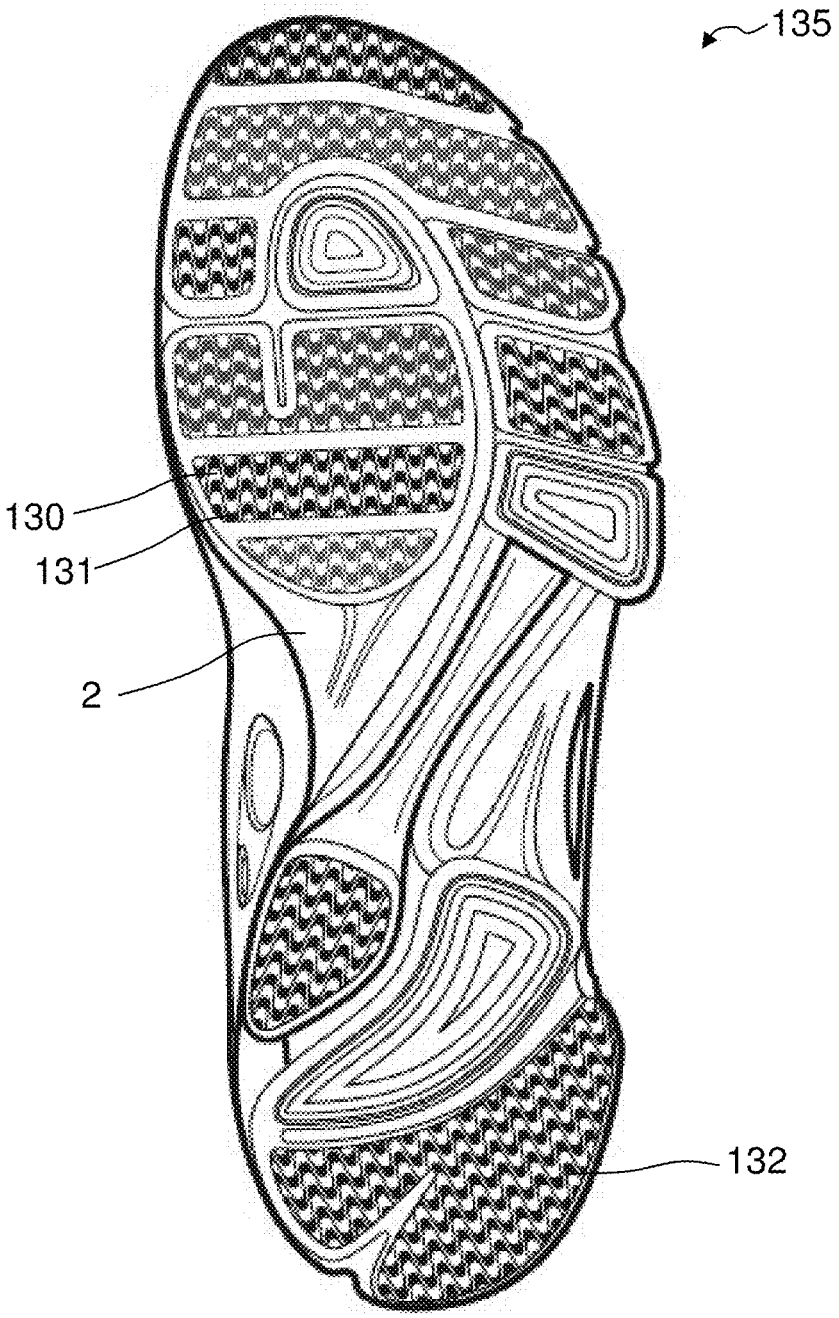
FIG. 9 is an even further view of the bottom of a midsole and an outsole

FIG. 9 shows an even further example of the bottom of a midsole 135, which midsole has a TPU intermediate layer 2 and an alternative tread. Discrete outsole element 130 exhibits undulating channels 131, which acts as grooves transporting the water away. Typically, grooves of one millimeters are used. The outsole in FIG. 9 shows the use of a mixture of the outsole elements of FIGS. 8 and 9. The discrete outsole element 132 in the lower heel portion exhibits undulating channels in a direction slanted to the longitudinal direction of the sole.

FIG. 10 shows in a lateral side view an embodiment of the midsole 135 with discrete outsole elements 139 and a TPU intermediate layer 134. The shank 4 is integrated in the sole and not visible. The heel end 137 extends vertically to a top point 152 on the medial side of the midsole and to a lower point 140 at the centre of the heel end 137. The upper heel portion thus extends to the location where the Achilles' tendon is fixed to the calcaneus, and the upper heel portion essentially covers the tuberosity of the calcaneus on the medial and the lateral side. An opening 144 is made on the lateral side in order to increase flexibility by lowering the structural support given in this area. However, in principle the whole calcaneus can be supported by the vertically extended midsole material. The heel is extended vertically to a point essentially corresponding to the superior tuberosity of the calcaneus, see reference number 67 in FIG. 5. A support arm 145 connects the heel end 137 with the lateral heel portion 151, and ensures stability. By extending the heel of the midsole into an upper heel portion which forms an integrated entity, (preferably as described injection moulded) the heel cap of traditional shoes can be omitted, hereby simplifying the shoe and reducing weight and cost. In one example, the vertical height measured from the geometric plane corresponding to surface 149 to lower top point 140 is 61 millimeters. With TPU intermediate layer 2 and discrete outsole elements mounted the height becomes 65 millimeters.

On the lateral side of the midsole 135, a measure is taken to compensate for the proximal head of the fifth metatarsal phalanges which causes a protrusion or a local extremity of the foot, also known as tuberositas ossis, see reference number 86 in FIG. 6. This head, if encapsulated by a relatively stiff sole material, will be subjected to friction between head and sole material, and will reduce the flexibility of the shoe. In order to avoid this friction and to allow the head and the joint free movement, an opening or window 148 as shown in FIG. 10 is created in the midsole material. Thus, in this area of the midsole, the midsole is devoid of sole material.

FIG. 11 shows midsole 135 from the medial side with the large support area of the medial heel portion 143. As described, top point 152 is in the area of the superior tuberosity of the calcaneus. From this point, the edge of the midsole of medial heel portion degrades in a direction towards the toe end along a curve 154 via supporting arm 155 to the forefoot. A corresponding support arm is found on the lateral side, reference number 156 (FIG. 10). Thus the midsole 1 is raised vertically on the lateral side and on the medial side with the idea of supporting the foot by using support structures 157 and 158 respectively. These structures give the medial upper arch an elastic and adjustable support. Thus, support structure 158 adds support shortly after heel strike e.g. in a case where the foot tends to pronate. The support is achieved because the PU material of the midsole has sufficient mechanical strength to exert a stabilizing force. In principle the support structure 158 could be made without window 159, but the supporting arm 155 has proved to give sufficient support. Additionally, structural element 160 has been added for further reinforcement. The vertical height of support structure 158 extends up to or above the upper half of the navicular bone 71 and medial cuneiform bone 72 and extends in longitudinal direction to approximately the start of the first metatarsal phalanges.

Preferably, the support structures 158 and 157 are inclined inwardly to follow the shape of the foot. As the support structures are an integrated part of the midsole and thus made of polyurethane in the preferred embodiment, the support structures have the same material characteristics as PU and are thus able to keep the inclination during use and to exert a pressure against the upper 166 and the arch. The lateral and medial support structures are bonded to the upper in a polyurethane injection process.

Toe end 36 (FIGS. 1*a*, 1*b*, 2*a*, 2*b*, 10, 11, 12 and 13) is likewise bonded to the upper in the injection process, and forms an integrated part of the midsole. The toe end is materially connected with the support structures 163 and 162 through a rim in the forefoot area, and is extended vertically from the base of the midsole 1 and curved inwardly and pointing towards the heel. The design of this integrated toe cap follows the general inventive concept, namely to increase the supporting material surface on the medial side as compared to the lateral side. Thus, as shown on FIG. 11, toe end 36 covers on its medial side an area larger than on the lateral side as shown in FIG. 10. The extended toe end 36 is offset from a longitudinal centre line through the midsole to the medial side, and stabilizes the foot during running and protects the toes and the upper.

FIGS. 12 and 13 show an even further embodiment of a midsole 161 provided with an upper 166. Support structures 162 and 163 are in this embodiment made as a supporting mesh with openings 164 and 165. Looking at the medial side in FIG. 12, sufficient structural support is ensured by support arms 172 extending upwards to the lacing area 173 and creating crossing sections 167, 172. The support structure 163 describes a structural mechanical stabilizing connection between the medial heel end and the medial forefoot, which ends in the upwardly extending toe end 36.

The described embodiments can be combined in different ways.

The invention claimed is:

1. Sole for a shoe, in particular for a running shoe, the sole comprising:

a polyurethane injected midsole extending continuously from a heel area to a forefoot area;

a longitudinally extending shank, the shank having a lower surface: and an outsole having an outer surface;

said shank extending from the forefoot of the sole through an arch area to the heel area and having an opening in its heel area for receiving polyurethane of the midsole;

wherein the lower surface of the shank in the heel area is offset to be closer to the outer surface of the outsole in a vertical direction than the lower surface of the shank in the arch area; and the sole further comprising a comfort element having a higher elasticity than the polyurethane of the midsole;

wherein the comfort element is placed in a cavity above said opening of the shank, and is bonded to the polyurethane of the midsole.

2. The sole according to claim 1, wherein the comfort element on a surface facing a textile sole of an upper is devoid of polyurethane from the midsole.

3. The sole according to claim 2, wherein the comfort element on a surface facing the shank has a nose corresponding to an opening's size and protruding into the opening towards the polyurethane of the midsole.

4. The sole according to claim 2, wherein a ratio of the height of the comfort element to the height of polyurethane of the midsole below the cavity is below 2:1.

5. The sole according to claim 2, wherein a ratio of the comfort element's height to the height of polyurethane of the midsole below the cavity is below 1.5:1.

6. The sole according to claim 2, wherein an energy absorption polyurethane layer, which as a lower density than the polyurethane of the midsole and has a thickness of 0.5 to 1.5 millimeters, is placed on the side of the textile sole of the upper facing the shank and the polyurethane midsole.

7. The sole according to claim 1, wherein the transition zone from the arch area of the shank to the heel area has an angle of maximum 50° related to the horizontal plane of the offset shank in the heel area.

8. The sole according to claim 7, wherein the transition zone slopes from the arch area towards the heel area, and from the medial side to the lateral side.

9. The sole according to claim 1, wherein the opening in the offset heel area is essentially elliptical, and positioned above the point of touch down.

10. The sole according to claim 1, wherein the shank has curved fingers (15, 16) in the forefoot area, said shank having a hard region and a soft region and the fingers being bendable around a bending line between the hard region and the soft region.

11. The sole according to claim 1, wherein the heel area of the shank generally extends along a first plane and at least a portion of the arch area of the shank generally extends along a second plane, where the first and second planes are substantially parallel to a horizontal ground plane, and wherein a vertical distance between the first plane and the horizontal ground plane is less than a distance between the second plane and the horizontal ground plane.

12. The sole according to claim 11, wherein the shank includes a transition area which extends at an angle from the first plane of the heel area to the second plane of the arch area, where the angle is about 50° or less relative to the first plane.

13. The sole according to claim 1, wherein the shank includes said cavity delimited by the offset heel area and a rim which extends around the opening, wherein the cavity is configured to receive and retain the polyurethane of the midsole.

14. The sole according to claim 1, wherein the offset heel portion of the shank is configured to dispose vertically closer to the outsole than to a foot of a wearer.

15. The sole according to claim 14, wherein the arch area of the shank is configured to disposed vertically closer to the foot of a wearer than to the outsole when worn.

* * * * *